United States Patent [19]

Jacobs

[11] 4,307,694

[45] Dec. 29, 1981

[54] DIGITAL FEEDBACK SYSTEM

[75] Inventor: Thomas H. Jacobs, Canton, Mich.

[73] Assignee: Ford Motor Company, Dearborn, Mich.

[21] Appl. No.: 155,280

[22] Filed: Jun. 2, 1980

[51] Int. Cl.[3] ..... F02M 51/00

[52] U.S. Cl. ..... 123/489; 123/440; 60/276

[58] Field of Search ..... 123/489, 440, 478; 60/276, 285

[56] References Cited

U.S. PATENT DOCUMENTS

| | | | |
|---|---|---|---|
| 3,895,611 | 7/1975 | Endo et al. | 60/276 |
| 3,900,012 | 8/1975 | Wahl et al. | 123/478 |
| 3,990,411 | 11/1976 | Oberstadt et al. | 60/276 |
| 4,027,637 | 6/1977 | Aono | 123/489 |
| 4,111,171 | 9/1978 | Aono et al. | 123/489 |
| 4,130,095 | 12/1978 | Bowler et al. | 123/440 |
| 4,202,301 | 5/1980 | Early et al. | 123/440 |
| 4,204,482 | 5/1980 | Harada et al. | 123/489 |

*Primary Examiner*—P. S. Lall

*Attorney, Agent, or Firm*—Peter Abolins; Clifford L. Sadler

[57] ABSTRACT

This specification discloses an apparatus and method for controlling the air fuel ratio in an internal combustion engine. The instantaneous air fuel ratio is compared with the inverse of a prior art fuel ratio to determine if an adjustment is necessary. If the inverted prior state of the air fuel ratio is the same as the present state, no change to the air fuel ratio will occur. If the inverted prior state is not the same as the present state, a control correction in the air fuel ratio will occur. The system will not change control voltage if the predicted stated and the actual state of the air fuel ratio agree.

6 Claims, 7 Drawing Figures

A/F SENSOR OUT Q
1
0
ΔT
DELAY REGISTER OUTPUT-ΔTQ̄
COUNT UP (RICHER)
NOT ENABLED
COUNT DOWN (CLEANER)
PERIOD
A B C D E F G H I J K L M N O P Q R S T U V W X
CORRECTIVE VOLTAGE
+3
+2
+1
0
-1
TIME

DIGITAL FEEDBACK SYSTEM

BACKGROUND OF THE INVENTION (1) Field of the Invention

This invention relates to an apparatus and method for controlling the air to fuel ratio of an internal combustion engine.

(2) Prior Art

The air fuel ratio of an internal combustion engine can be determined by an analysis of the exhaust gases. For example, a sensing device located in the exhaust gas stream can sense the partial pressure of oxygen thereby determining whether the air fuel mixture is rich or lean of stoichiometry. Stoichiometry is the ratio of 14.6 parts air to 1 part fuel wherein complete combustion takes place. In many engine strategies, it is desirable to operate at stoichiometry.

A feedback control system in combination with the sensor can be used to vary the air fuel ratio supply to the internal combustion engine. The control system processes a signal derived from the sensing device and causes a change in the ratio in the air to fuel mixture applied to the internal combustion engine by, for example, increasing or decreasing the amount of fuel instantaneously added to a predetermined air quantity. The air fuel mixture ratio can be variable with engines having carburetors as well as fuel injection systems. Of course, the type of controller is advantageously adapted to the particular type of fuel supply systems.

A widely used technique to control the air fuel ratio in stoichiometric feedback controlled fuel metering systems is limit cycle integral control. In this technique, there is a constant movement of a fuel metering component in a direction that always tends to counter the instantaneous air fuel ratio indication given by a typical two state exhaust gas oxygen (EGO) sensor. For example, every time an EGO sensor indicates a switch from rich to lean air fuel ratio mode of operation, the direction of motion of a typical carburetor's metering rod reverses to create a richer air fuel ratio condition until the sensor indicates a change from a lean to rich air fuel ratio condition. Then, the direction of motion of the metering rod is reversed again this time to achieve a leaner air fuel ratio condition.

Referring to FIGS. 1*a* and 1*b*, step like changes in the sensor output voltage initiate ramp like changes in the actuator control voltage. When using the limit cycle or integral control, the desired air fuel ratio can only be attained on an average basis since the actual air fuel ratio is made to fluctuate in a controlled manner about the average value. The limit cycle system can be characterized as a two state controller and the mode of operation can be rich or lean. The average deviation from the desired value is a strong function of a parameter called engine transport delay time, $\tau$. This is defined as the time it takes for a change in air fuel ratio, implemented at the fuel metering mechanism, to be recognized at the EGO sensor, after the change has taken place.

The engine transport delay time is a function of the fuel metering systems's design, engine speed and air flow. Because of this delay time, a control system using a limit cycle technique always varies the air fuel ratio about a mean value in a cyclical manner, for example, a richer fuel ratio typically followed by a lean air fuel ratio with overshoots. The shorter the transport delay time is, the higher will be the frequency of rich to lean and lean to rich air fuel ratio fluctuations and the smaller will be the amplitudes of the air fuel ratio overshoots. It can be appreciated that a system with no engine transport delay time is the ideal.

Known control devices for changing the air fuel ratio have various drawbacks. For example, the control apparatus may include a motor which operates a valve controlling the air fuel ratio, the motor having a preset driving speed. Because of the fixed driving speed changing the air fuel ratio, the desired change is not instantaneous and, during transition, the instantaneous air fuel ratio is different from the desired air fuel ratio. The engine transport delay time also causes a delay from the time of the change in the air fuel ratio at the intake system to the time the gas sensor senses the change at the exhaust system. This can produce unsatisfactory control of the air fuel ratio. If the delay time increases due to such conditions as low rotational speed, the control apparatus may be susceptible to a hunting phenomenon wherein the actual air fuel ratio has oscillatory values compared to the desired air fuel ratio. As is known, any variation from the desired air fuel ratio may reduce drivability, decrease mileage and deteriorate quality of the exhaust gas thereby increasing pollutants.

Known air fuel ratio controllers have a disadvantage in that the integration time constant for correction of the air fuel ratio is independent of engine speed. The main delay within the control loop (which includes the exhaust sensor, the controller, and the adjustment mechanism controlling the actual air fuel ratio mixture) is given by the time which the mixture takes on the path from the carburetor, or injection system, through the internal combustion engine. The air fuel mixture must pass through the internal combustion engine, and be delayed by the various strokes of the combustion engine, before the controller becomes sensitive to the exhaust gases and can determine the change in the composition of the exhaust gases. If an average, medium speed of the engine is assumed by picking an appropriate integration constant, then when the speed of the engine is low, the longer time of passage of the air fuel mixture through the engine causes integration of the integral controller to be too rapid. Correction of the mass ratio of the air fuel mixture applied to the internal combustion engine will thus be excessive and a deviation from command value in the opposite direction will result. Conversely, at speeds higher than the speed for which the integral controller operates at optimum value, the control effect is too slow, and the desired command value is reached only slowly. The control of the air fuel ratio should be accurate over the speed range of the engine. Further, the system and apparatus should be inexpensive and simply constructed. These are some of the problems this invention overcomes.

SUMMARY OF THE INVENTION

A feedback apparatus for controlling the air fuel ratio of an internal combustion engine, in accordance with an embodiment of this invention, includes a sensor means, an engine revolution detecting means, a delay register means, a logic means and an air fuel ratio control system.

The sensor means is coupled to the exhaust system associated with the internal combustion engine for sensing the air fuel ratio. The revolution detecting means is coupled to the internal combustion engine for sensing the revolution rate of the internal combustion engine. The delay register means is coupled to the sensor means and the revolution detection means for temporary storage of inverted sensor information so that the output of the delay register means is delayed with respect to the input of the delay register means and thus can relate to previous engine cycles. The period of delay is a function of engine rpms.

The logic means has one input coupled to the sensor means and another input coupled to the delay register. An output node of the logic means carries a first output when the two inputs are the same and a second output when the two inputs are different. The control system for the air fuel mixture supplied to the internal combustion engine is coupled to the output of the logic means so that the control system causes no change in the air fuel ratio when the first output is received.

Where present feedback control systems are unstable in nature in that the voltage is always changing to steer the sensor from rich or lean, a control system in accordance with an embodiment of this invention has three states: up to go rich, down to go lean, and no change if the predicted agrees with the actual state of the sensor. In a steady state, a feedback apparatus in accordance with an embodiment of this invention is characterized by the sensor output alternating between high and low states.

DETAILED DESCRIPTION OF THE INVENTION

Figure 1A:
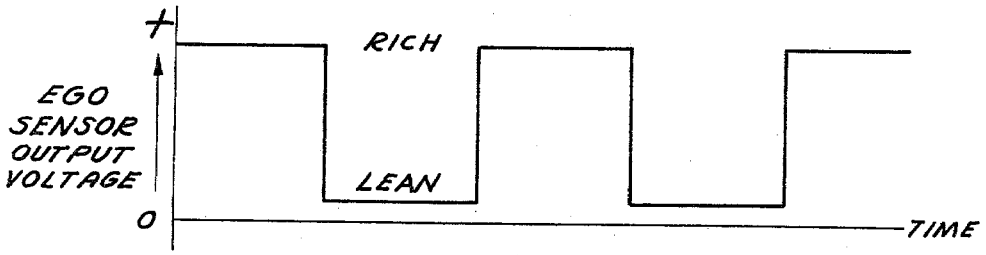
FIG. 1A PRIOR ART
FIG. 1*a* is a graphical representation of the EGO sensor output voltage with respect to time in accordance with a prior art limit cycle controlled technique.
Figure 1B:
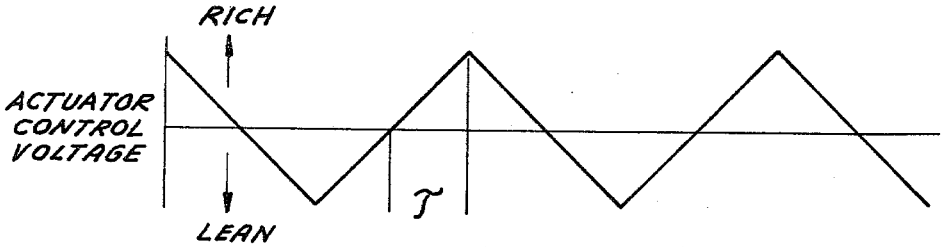
FIG. 1B PRIOR ART
FIG. 1*b* is a graphical representation of the actuator control voltage with respect to time corresponding to the prior art sensor output voltage of FIG. 1*a;*
Figure 2:
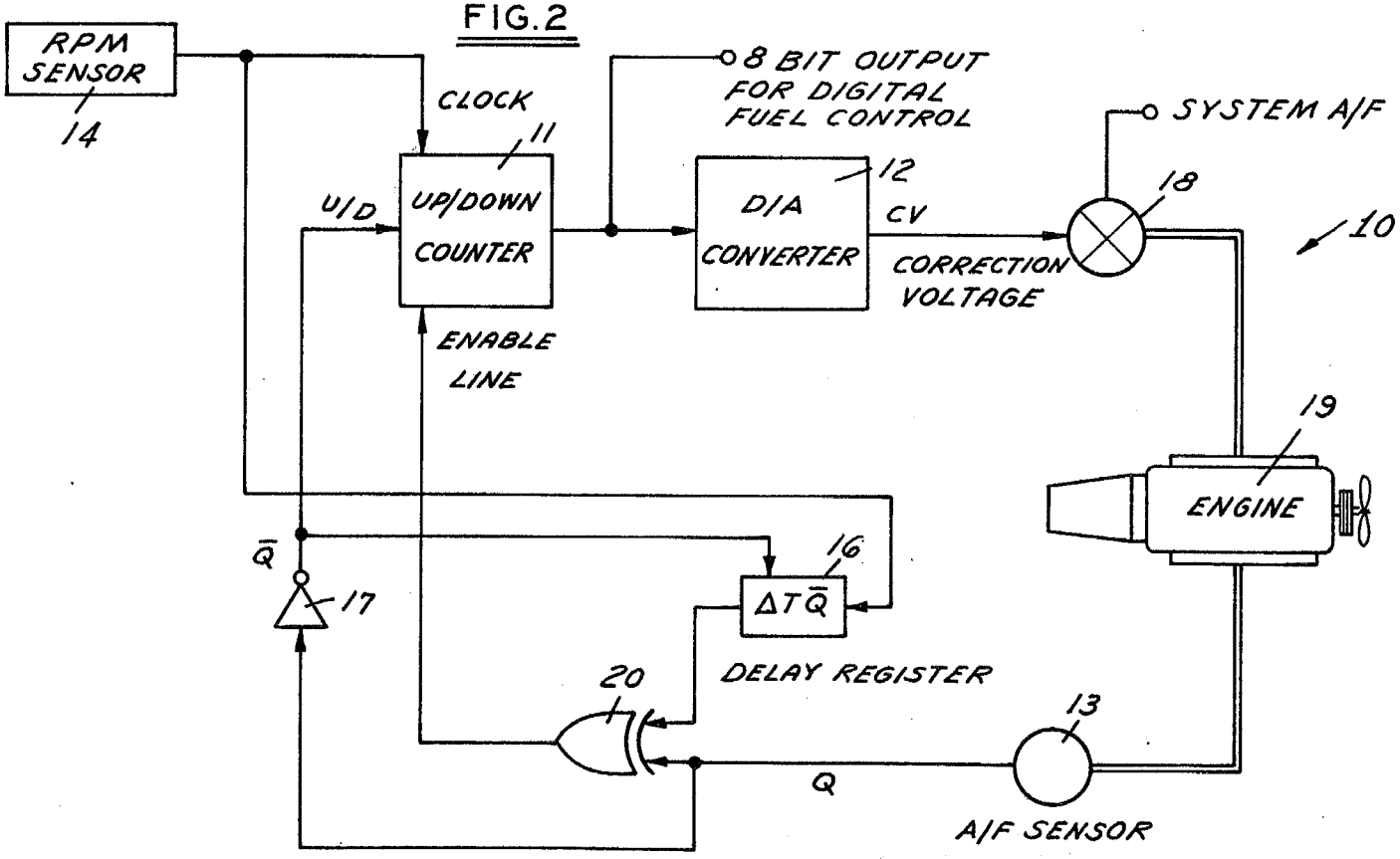
FIG. 2 is a schematic, partly block, diagram of a feedback system in accordance with an embodiment of this invention.

Referring to FIG. 2, feedback system 10 includes an up-down counter 11 clocked by rpm provided by an rpm sensor 14, converter 12 to provide an interface between counter 11 and an analog fuel system, an exhaust gas air fuel ratio sensor 13, an exclusive OR gate 20, a delay register 16 also clocked by rpm and an inverter 17. Coupled within feedback system 10 is a fuel control system 18 to modulate the air fuel ratio for an engine 19 having an engine transport delay time $\Delta T$ or $\tau$. The fuel system may be digital or analog. If the fuel system is digital, the digital to analog converter 12 is not needed.

The output of air fuel sensor 13 is a high level or a low level depending upon the exhaust mixture being rich or lean. In operation, a change in the system air fuel ratio as established by a setting of fuel control system 18 requires time to reach exhaust sensor 13. This time is approximately 2 engine cycles and is the transport delay time $\Delta T$ of engine 19. Air fuel sensor 13 switches between rich and lean as the exhaust air fuel ratio indicates a rich or lean mixture. The output signal of sensor 13 is applied to an input of exclusive OR gate 20. The other input to exclusive OR gate 20 is from delay register 16 which contains inverted sensor information 2 cycles old. If the information characterizing the delayed state is the same as the information characterizing the present state, no change to the air fuel ratio established by fuel system 18 will occur. If the delayed state is not the same as the present state, up-down counter 11 will be enabled by the output of exclusive OR gate 20. The direction of correction, i.e., up or down counting, is determined by the output of inverter 17 when applied to counter 11. The speed of counting is determined by a clock input to counter 11 from rpm sensor 14. The output of counter 11 is a control correction voltage to be applied to fuel system 18 through converter 12. Feedback system 10 will not change the control or correction voltage supplied by counter 11 if the inverted prior state of the sensor 13 and the actual state of sensor 13 agree.

Present feedback control systems are unstable in nature in that the fuel system control voltage is always changing to steer the sensor from rich to lean or vice versa. In accordance with an embodiment of the invention, there is no continuing voltage applied to intentionally cause a continuing variation of the air fuel ratio. Instead, a control or correction voltage has three states: up to go rich, down to go lean, and no change if the predicted state agrees with the actual state of the sensor. In a steady state control mode the sensor would alternate between high low states due to random deviations from stoichiometry.

The operation of exclusive OR gate 20 can be summarized by the following table:

| First input | Second input | Output |
|---|---|---|
| lean | lean | do nothing |
| lean | rich | do something |
| rich | lean | do something |
| rich | rich | do nothing |

In operation, exhaust air fuel sensor 13 is treated as a digital logic unit and has a sensor output signal, Q, which is either a high level or a low level depending on whether the exhaust mixture is rich or lean. As noted before, the output of the digital to analog converter 12, the corrective voltage, occurs when the two inputs to the exclusive OR gate 20 are different. Inverter 17 converts the output of exhaust air fuel sensor 13 so that if the sensor output indicates rich then the output of the converter 17 indicates that the system should go lean. Similarly, if the output of exhaust sensor 13 indicates a lean situation, the output of inverter 17 will indicate that the system should go rich. This anticipated correction is supplied to delay register 16 and is processed through delay register 16 so that it arrives at OR gate 20 after a transport time which corresponds to the time air fuel sensor 13 would respond to the new corrective value and provide the other input to exclusive OR gate 20. Accordingly, the two inputs representing the corrected air fuel ratio should arrive at the same time and, since both inputs are the same, the output of exclusive OR gate 20 would indicate that further correction is necessary. The transport time selected for use within delay register 16 is a function of the rpm's as shown by the input from the rpm sensor 14.

Up-down counter 11 has an input from rpm sensor 14 which provides a clock pulse thereby determining the speed with which the counter counts. Up-down counter 11 also has an input from exclusive OR gate 20 determining whether or not any counting takes place. Finally, up-down counter 11 has an input from inverter 17 to determine whether the count is to be up or down depending upon whether the fuel mixture is to be made richer or leaner. This correction output from up-down counter 11 is applied through a digital time lock converter 12 to fuel system controller 18 thereby changing the air fuel ratio in the flow to the engine.

Figures 3A, 3B, 3C, 3D:
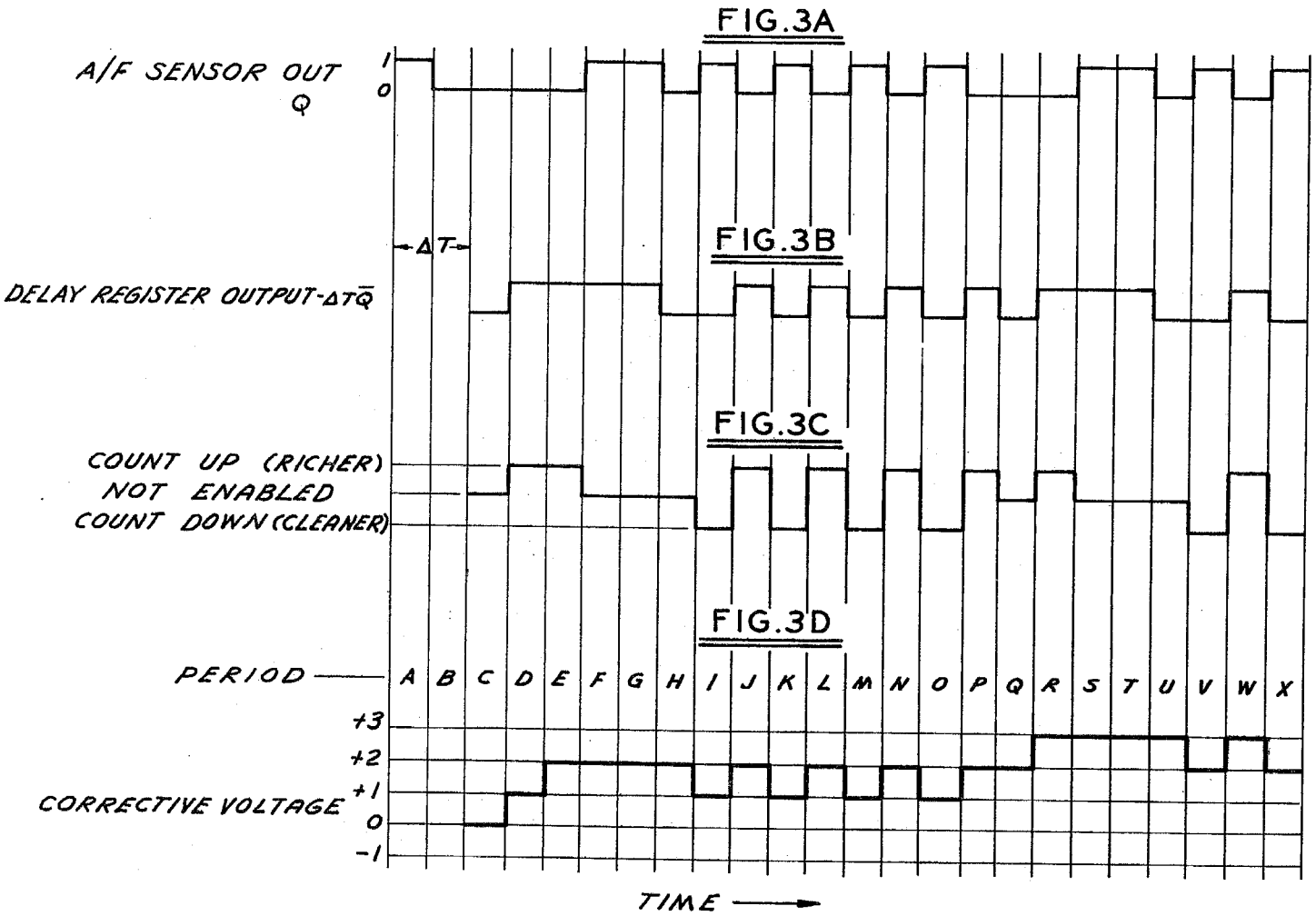
FIGS. 3*a* through 3*d* are voltage forms with respect to time taken at various points in the circuit of FIG. 2 and indicate how the output of the air fuel sensor at FIG. 3*a* and the output of the delay register at FIG. 3*b* enable the counter at FIG. 3*c* to produce a corrective voltage at FIG. 3*d.*

Referring to FIG. 3*a*, the output of air fuel sensor 13 is indicated as being either rich, indicated by a digital 1 or lean, as indicated by a digital zero. Along the horizontal time axis each square or period labeled with a letter of the alphabet indicates one revolution or one sampling. FIG. 3*b* shows the output of delay register 16 which is an inversion of the waveform shown in FIG. 3*a* delayed by the transport delay, ΔT. In this figure, ΔT is chosen to be two periods long so that the air fuel state shown in FIG. 3*a* at period A is reflected in FIG. 3*b* at period C. The excursions in FIG. 3*b* are also between a zero and a one level as in FIG. 3*a*. FIG. 3*c* indicates whether the counter 11 is disabled, or counting upward or counting down. More particularly, in a given period, the state of the waveform in FIG. 3*a* is compared to the state of the waveform in FIG. 3*b*. If they both are the same level, nothing is done. If the waveforms are of a different level then the counter is enabled. If the counter is enabled, the direction of counting is determined by the state of the waveform in FIG. 3*a* and is in a direction to oppose it. That is, if the counter is enabled and the state of the waveform in FIG. 3*a* is lean then the counter will increase to go richer. For example, in period C,Q, the waveform in FIG. 3*a*, and $\overline{Q}$ the waveform of FIG. 3*b* are both lean, in the same state, so that counter 11 is not enabled. In period D,Q is lean and $\overline{Q}$ is rich so that the counter is enabled and counts up in a rich direction to counteract the sensed lean air fuel ratio. Similarly, in period E the states of Q and $\overline{Q}$ are different and the count is in a rich direction to counteract the lean air fuel ratio. Similarly, in periods of F and G both Q and $\overline{Q}$ are rich so that the counter 11 is not enabled. In period H both Q and $\overline{Q}$ are lean so the counter remains not enabled. In period I the states of Q and $\overline{Q}$ are different and the counter counts down, or leaner, to counteract the rich state of Q. In period J, the states are different and the counter counts up rich to counteract the lean state of Q. In period K, the states of Q and $\overline{Q}$ are different and the counter counts down to counteract the rich state of Q. In period O, the states of Q and $\overline{Q}$ are different and the counter counts up, rich, to counteract the lean state of Q. in period M the states of Q and $\overline{Q}$ are different and the counter counts down or in the lean direction to counteract the rich state of Q. The remaining states follow the same rules for determining the direction of count. Note that when the air fuel is at approximately the desired setting it can be expected that the air fuel sensor will then indicate alternate rich and lean states due to such factors as random variations.

Referring to FIG. 3*d*, the corrective voltage is the output of digital to analog converter 12 and can be derived from the waveform of FIG. 3*c*. Starting at period C of the waveform of FIG. 3*c*, a not enabled indication produces zero corrective voltage. A count up indication during period D indicates that the corrective voltage counts up to a plus one. The count up indication remains on during period E so the corrective voltage jumps another increment to a plus two. During periods F, G and H, the counter is not enabled so that the corrective voltage continue to stay at the plus two voltage. During period I, the counter counts down to a leaner air fuel ratio and thus reduces the corrective voltage by one increment so that during period I it is a plus one. During period J, the counter counts up and the corrective voltage also jumps up one to a plus two. During period K, the counter counts down and the corrective voltage drops one to plus one. The remaining states of the corrective voltage of FIG. 3*d* are governed by the fluctuation shown in FIG. 3*c*.

Various modifications and variations will no doubt occur to those skilled in the various arts to which this invention pertains. For example, the particular electrical components to implement the functions disclosed may vary from that disclosed herein. These and all other variations which basically rely on the teachings through which this disclosure has advanced the art are properly considered within the scope of this invention.

I claim:

1. A feedback apparatus for controlling the air fuel ratio in an internal combustion engine comprising:
   - a sensor means coupled to an exhaust system associated with the internal combustion engine for sensing the air-to-fuel ratio and providing a binary output indicative of the air fuel ratio being either rich or lean of stoichiometry;
   - a revolution detecting means coupled to the internal combustion engine for sensing the revolution rate of the internal combustion engine;
   - an inverter means coupled to said sensor means for inverting the state of the output of said sensor means;
   - a delay register means coupled to said sensor means through said inverter means and said revolution detecting means for delaying the passage of inverted information as a function of the revolution rate;
   - a logic means having two inputs, coupled to said sensor means and said delay register means and having an output node with a first output when the two inputs are the same and a second output when the two inputs are different; and
   - a fuel control system for the air fuel mixture supplied to the internal combustion engine, said control system being coupled to the output of said logic means so that the control system causes no change in the air fuel ratio when said first output is received, and causes a change in the air fuel ratio when said second output is received, the direction of change being determined by the output of said inverter means.

2. A feedback apparatus as recited in claim 1 wherein:
   - said delay register means is adapted to delay the passage of inverted sensor information so that the output of said delay register means characterizes a previous engine cycle occurring prior to the current engine cycle by a time interval equal to about the transport delay time of the engine.

3. A feedback apparatus as recited in claim 2 wherein:
   - said sensor means is an oxygen exhaust gas sensor;
   - said revolution detecting means is an up-down counter coupled to an electric pulse generator having an output pulse repetition rate proportional to the internal combustion engine revolution rate;
   - said delay register is a shift register;
   - said logic means is an exclusive OR gate; and
   - said control system includes a digital to analog converter so that an average voltage can be developed.

4. A feedback apparatus as recited in claim 3 wherein:

said logic means receives a first input from said sensor means and a second input from an output of said delay register means;

said delay register means has a first input proportional to the revolution rate of the internal combustion engine and a second input inverse to the output of said sensor means;

said up-down counter having an enable input coupled to the output of said logic means, a clock input providing an input proportional to the revolution rate of the internal combustion engine and an up-down select input inverse to the output of said air fuel sensor;

said digital to analog converter having an input coupled to the output of said up-down counter for receiving a digital signal and an output for providing a correction voltage; and said control system also including a summer having a first input coupled to the output of said digital to analog converter, a second input for receiving an input proportional to the selected system air fuel ratio, and an output proportional to a corrected air fuel ratio.

5. A method for controlling the air fuel ratio in an internal combustion engine comprising the steps of:

sensing the air fuel ratio by a sensor means coupled to an exhaust system associated with the internal combustion engine;

sensing the revolution rate of the internal combustion engine;

inverting the sensor information;

storing the inverted sensor information in a delay register means;

comparing the stored inverted sensor information with current sensor information;

generating a first output when the comparison of the stored and current sensor information indicates they are the same and generating a second output when the comparison of the stored and current information indicates they are different; and adjusting the air fuel ratio only in the presence of the second output thus reducing instability.

6. A method as recited in claim 5 wherein the step of adjusting the air fuel ratio only in the presence of the second output includes the step of:

applying an enable signal to an up-down counter in response to the second output;

applying a clock signal to the up-down counter proportional to the revolution rate of the internal combustion engine;

applying an up-down select signal to the up-down counter, the select signal being inverse to the output of the air fuel sensor;

converting a digital output from the up-down counter to an analog signal for providing a correction voltage; and modifying a voltage proportional to the selected air fuel ratio by the correction voltage thus generating a corrected air fuel signal.

* * * * *